United States Patent [19]

Ishizuka

[11] 4,401,414

[45] Aug. 30, 1983

[54] SWASH-PLATE TYPE COMPRESSOR HAVING A SIMPLE LUBRICANT OIL FEEDING ARRANGEMENT

[75] Inventor: Yutaka Ishizuka, Konan, Japan

[73] Assignee: Diesel Kiki Co., Ltd., Tokyo, Japan

[21] Appl. No.: 294,394

[22] Filed: Aug. 19, 1981

[30] Foreign Application Priority Data

Aug. 30, 1980 [JP] Japan ..... 55-120239

[51] Int. Cl.[3] ..... F04B 39/02; F04B 1/18

[52] U.S. Cl. ..... 417/269; 92/153

[58] Field of Search ..... 417/269, 270, 271; 92/153

[56] References Cited

U.S. PATENT DOCUMENTS 3,215,341 11/1965 Francis .

4,127,363 11/1978 Iato ..... 417/269

4,229,145 10/1980 Izizuka ..... 417/269

4,260,337 4/1981 Nomura ..... 417/269

4,273,518 6/1981 Shibuya ..... 417/269

4,351,227 9/1982 Copp ..... 417/269

*Primary Examiner*—William L. Freeh

*Attorney, Agent, or Firm*—Frishauf, Holtz, Goodman and Woodward

[57] ABSTRACT

A swash-plate type compressor is provided with an oil pumping chamber which communicates with a fluid pumping chamber within which fluid is compressed by a piston, and also provided with a secondary oil reservoir chamber which communicates with an oil feeding bore formed in the drive shaft of the compressor. The oil pumping chamber communicates with a primary oil reservoir chamber through a first oil feeding passageway, and with the secondary oil reservoir chamber through a second oil feeding passageway, respectively. First and second valves are arranged to open and close the first and second oil feeding passageways, respectively, in response to changes in the pressure within the oil pumping chamber.

11 Claims, 8 Drawing Figures

SWASH-PLATE TYPE COMPRESSOR HAVING A SIMPLE LUBRICANT OIL FEEDING ARRANGEMENT

BACKGROUND OF THE INVENTION

This invention relates to a swash-plate type compressor, and more particularly to a simple lubricant oil pumping system which is provided within a compressor of this type for supplying lubricant oil to thrust bearings, radial bearings and other sliding machine parts of the compressor.

Many air conditioning systems employ swash-plate type compressors for compressing refrigerant gas. According to a typical swash-plate type compressor, a swash plate is arranged within a cylinder block and secured on a drive shaft extending through the cylinder block. Rotation of the swash plate causes reciprocating motions of pistons within their respective cylinder bores to carry out refrigerant gas compressing actions in cooperation with suction valves and discharge valves provided on valve plates mounted at the opposite ends of the cylinder block. The lubricant oil feeding system employed in such type compressor conventionally includes a type using a gear pump, such as a trochoidal type. The gear pump is arranged within the compressor in such a manner that an inner gear is secured on an end of the drive shaft of the compressor and meshes with an outer gear mounted in the cylinder head of the compressor, the inner and outer gears being rotatable in unison with rotation of the drive shaft to suck lubricant oil stored in the bottom of the cylinder block. The lubricant oil feeding system of this type is capable of supplying lubricant oil to required places in the compressor at a sufficient rate and with high stability.

However, the gear pump is rather expensive and requires large power to drive. Further, it is hard to mount in the compressor. That is, first the inner gear has to be rigidly mounted onto the drive shaft, and then the outer gear mounted into the cylinder head so as to mesh with the inner gear. Still further, metallic powder can be produced due to the meshing engagement of the inner and outer gears and entrained into the lubricant oil.

OBJECTS AND SUMMARY OF THE INVENTION

It is therefore an object of the invention to provide a lubricant oil feeding system for a swash-plate type compressor, which has a novel and simple arrangement and is inexpensive, and which is adapted to effect pumping action in response to pressure change in the pumping chamber within which refrigerant gas is compressed, to feed lubricant oil at a sufficient rate.

It is a further object of the invention to provide a lubricant oil feeding system for a swash-plate type compressor, which uses valve means in place of a gear pump, therefore does not require large power to drive, and will not produce metallic powder, thus being free from the phenomenon of metallic powder being entrained in the lubricant oil.

According to the invention, there is provided a swash-plate type compressor which comprises in combination: a cylinder block having at least one cylinder bore axially extending therethrough, a through bore extending along an axis thereof, and a first oil reservoir chamber formed therein at a bottom portion thereof; a drive shaft rotatably fitted in said through bore of said cylinder block, said drive shaft having an oil feeding bore extending along an axis thereof; a swash plate secured on said drive shaft; at least one piston slidably received within said at least one cylinder bore, said piston defining a fluid pumping chamber in cooperation with said cylinder bore; an oil pumping chamber premanently communicating with said fluid pumping chamber; said oil pumping chamber being supplied with pressure in said fluid pumping chamber which varies in response to a change in the volume of said fluid pumping chamber a second oil reservoir chamber communicating with said oil feeding bore of said drive shaft; a first oil feeding passageway communicating said oil pumping chamber with said first oil reservoir chamber; a second oil feeding passageway communicating said oil pumping chamber with said second oil reservoir chamber; a first valve responsive to a change in the pressure within said oil pumping chamber to open and close said first oil feeding passageway to control supply of lubricant oil solely from said first oil reservoir chamber to said oil pumping chamber; and a second valve responsive to a change in the pressure within said oil pumping chamber to open and close said second oil feeding passageway to control supply of lubricant oil solely from said oil pumping chamber to said second oil reservoir chamber.

The above and other objects, features and advantages of the invention will be more apparent from the ensuing detailed description taken in connection with the accompanying drawings.

DETAILED DESCRIPTION

The present invention will now be described in detail with reference to the drawings in which preferred embodiments of the invention are illustrated.

Figure 1:
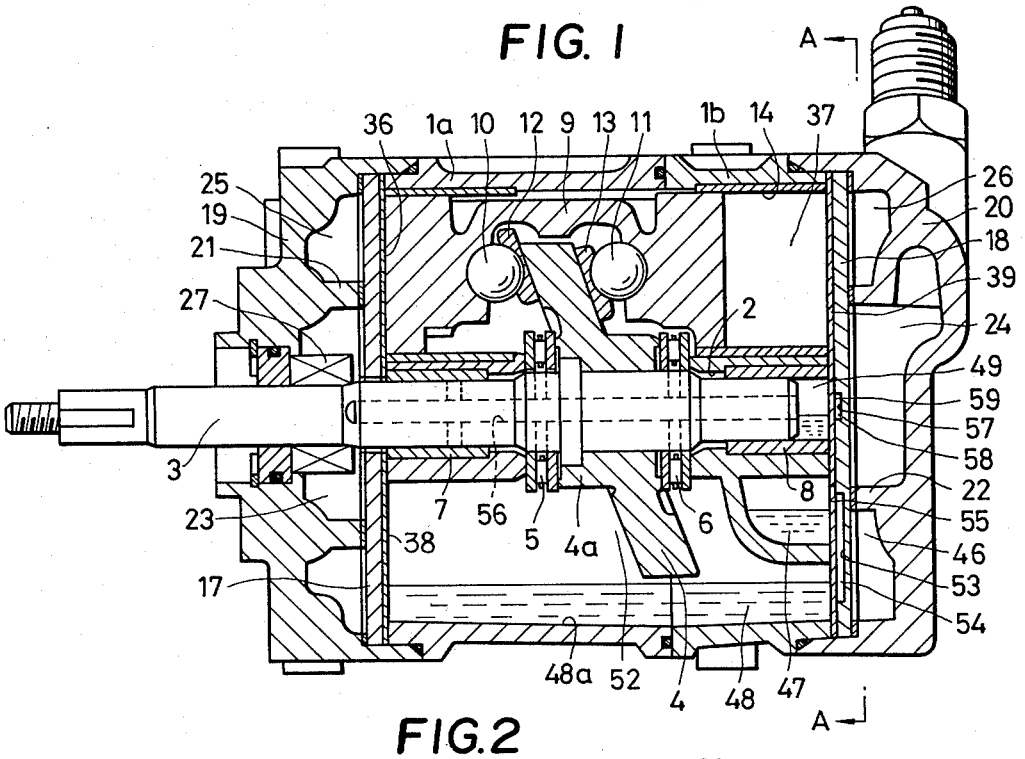
FIG. 1 is a longitudinal sectional view illustrating a swash-plate type compressor provided with a lubricant oil feeding system according to one embodiment of the invention.
Figure 2:
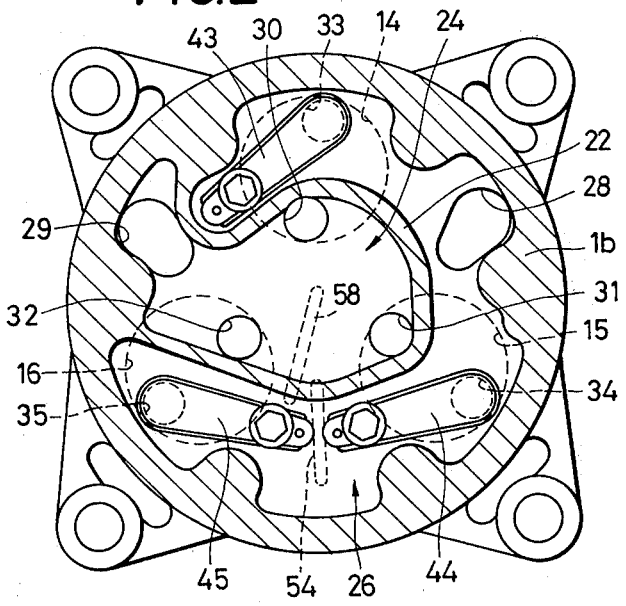
FIG. 2 is a sectional view taken along line A—A in FIG. 1.
Figure 3:
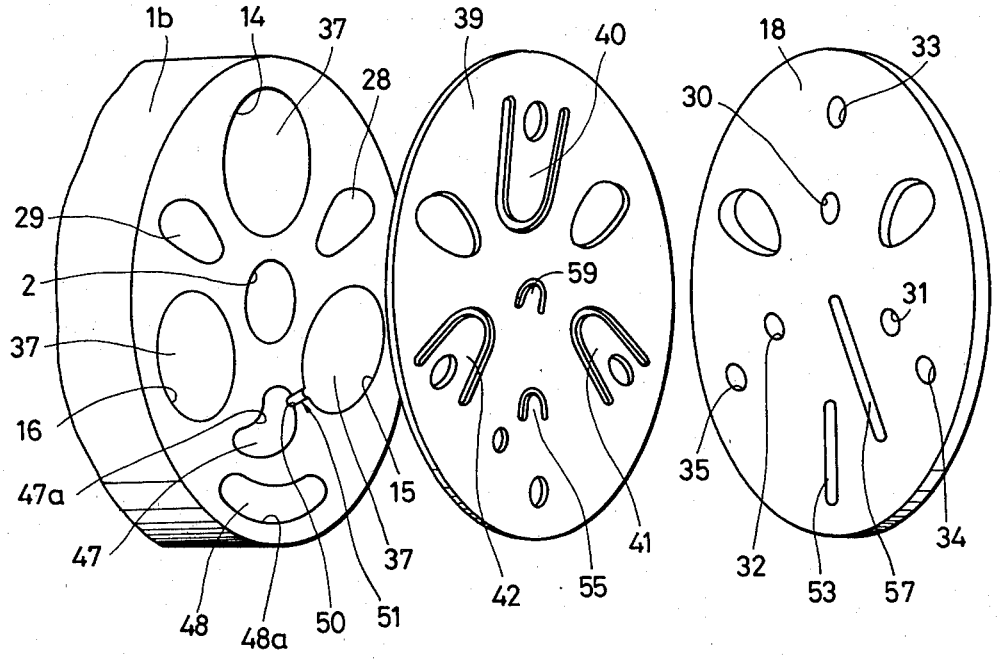
FIG. 3 is a perspective view illustrating the cylinder element, valve plate and gasket used on the rear side of the compressor of FIG. 1.

Referring first to FIGS. 1 through 3, there is illustrated a first embodiment of the invention. Reference numeral 1 designates a cylinder block which is formed of a pair of axially aligned cylinder elements 1*a*, 1*b*, and is formed along its axis with a through bore 2 in which a drive shaft 3 is rotatably fitted. The drive shaft 3 has its one end projected outwardly of the compressor, at which it receives driving force transmitted from a prime mover, not shown, to be rotated thereby. A swash plate 4 is obliquely secured on the drive shaft 3 at a substantially central portion within the cylinder block 1. The drive shaft 3 and the swash plate 4 are rotatably supported by thrust bearings 5, 6 mounted at the opposite sides of the boss 4*a* of the swash plate 4 and radial bearings 7, 8 mounted at the opposite ends of the through bore 2.

Three double-acting type pistons 9, only one of which is shown, are each formed with a recess at its central portion, in which recess is engaged the outer fringe of the swash plate 4 via balls 10, 11 and shoes 12, 13. These pistons 9 are received within their respective cylinder bores 14, 15, 16 formed through the cylinder elements 1*a*, 1*b* for reciprocating motions therein in unison with rotation of the swash plate 4.

Secured to the opposite ends of the cylinder block 1 are front and rear cylinder heads 19, 20 with valve plates 17, 18 intervening therebetween. The cylinder heads 19, 20 are each formed therein with a partition wall 21, 22 which defines a low pressure chamber 23, 24 and a high pressure chamber 25, 26 in cooperation with the inner walls of the cylinder head and the valve plate. A mechanical seal 27 is accommodated within the low pressure chamber 23 on the front side to seal the drive shaft 3 against the interior of the front cylinder head 19. The low pressure chamber 23 on the front side communicates with the low pressure chamber 24 on the rear side by means of a refrigerant passageway 28, and the high pressure chamber 25 on the front side with the high pressure chamber 26 on the rear side by means of a refrigerant passageway 29, respectively, the both passageways 28, 29 being formed through the cylinder block 1.

The valve plates 17, 18 are each formed with suction openings 30, 31, 32 and discharge openings 33, 34, 35 at locations corresponding to the cylinder bores 14, 15, 16. The suction openings 30, 31, 32 communicate refrigerant pumping chambers 36, 37 defined within the cylinder bores 14, 15, 16 at the opposite ends of the pistons 9, with the respective low pressure chambers 23, 24. These openings 30, 31, 32 of each valve plate 17, 18 are provided with reed type suction valves 40, 41, 42 formed integrally on a gasket 38, 39 which is interposed between the cylinder block 1 and the valve plate 17, 18, to be closed thereby. These suction valves 40, 41, 42 are adapted to be opened during each suction stroke of the respective pistons 7 when refrigerant gas is sucked into the refrigerant pumping chamber 36, 37. On the other hand, the discharge openings 33, 34, 35 of each valve plate 17, 18 communicate the refrigerant pumping chambers 36, 37 with the respective high pressure chambers 25, 26 and are provided with discharge valves 43, 44, 45 mounted on the valve plate 17, 18 to be closed thereby. These discharge valves 43, 44, 45 are adapted to be opened during each discharge stroke of the respective pistons 7 when refrigerant gas is discharged into the high pressure chamber 25, 26.

In the illustrated embodiment, a lubricant oil feeding system 46 is provided on the rear side of the compressor. This lubricant oil feeding system 46 has a simple oil pumping arrangement which is actuatable in response to pressure change in an oil pumping chamber 47 which is formed in the cylinder block in communication with one of the refrigerant pumping chambers 37, to suck lubricant oil stored in a primary oil reservoir chamber 48 and pump it into a secondary oil reservoir chamber 48.

More specifically, the oil pumping chamber 47 is defined by a recess 47*a* formed in the rear end face of the cylinder element 1*b* at a location intermediate between the shaft-fitted bore 2 and the primary oil reservoir chamber 48, and the gasket 39. The recess 47*a* has a cross section with a narrow radially inner portion extending toward the above one of the refrigerant pumping chambers 37. The oil pumping chamber 47 communicates with the above refrigerant pumping chamber 37 which is closest to the chamber 47, via a communication passage 51 defined by a groove 50 formed in the rear end face of the cylinder element 1*b* and the gasket 39 so that the pressure in the chamber 47 varies in response to a change in the volume of the refrigerant pumping chamber 37.

The primary oil reservoir chamber 48 is formed in the cylinder block 1 at the bottom below a swash plate chamber 52 within which the swash plate 4 is placed, and is defined by a cavity 48*a* formed at the bottom of the cylinder block 1 and the gaskets 38, 39. Lubricant oil is separated from blow-bye gas present in the swash plate chamber 52. This primary oil reservoir 48 communicates with the oil pumping chamber 47 through a first oil feeding passageway 54 which is defined by a groove 53 formed in a side surface of the valve plate 18 facing the cylinder block 1, and the gasket 39. The above groove 53 has its one end opening in the primary oil reservoir chamber 48, and its other end in the oil pumping chamber 47, respectively. The outlet end of the first oil feeding passageway 54 which thus opens in the oil pumping chamber 47 is provided with an oil suction valve 55 formed integrally on the gasket 39, to be closed thereby. This oil suction valve 55 comprises a tab-like reed formed by cutting part of the gasket 39, the reed having its free end disposed for urging contact with a portion of the side surface of the valve plate 18 facing the cylinder block 1 and adjacent the aforementioned other end of the groove 53, to close the passageway 54 when the oil pumping chamber 47 is higher in pressure than the primary oil reservoir chamber 48, while it is pivotally displaceable away from the above portion of the side surface of the valve plate 18 to open the passageway 54 when there occurs a drop in the pressure in the oil pumping chamber 47 below the pressure in the primary oil reservoir chamber 48.

The secondary oil reservoir chamber 49 is defined by the peripheral wall of the rear end portion of the through bore 2, the rear end face of the drive shaft 3, the radial bearing 18 and the gasket 39 and communicates with an oil feeding bore 56 extending in the drive shaft 3 along its axis. This oil feeding bore 56 opens at its one end in the rear end face of the drive shaft 3, at its other end in the low pressure chamber 23 in the vicinity of the mechanical seal 27, and at its intermediate portions in portions of the through bore 2 facing the thrust bearings 5, 6 and the radial bearing 7 on the front side, respectively. The secondary oil reservoir chamber 49 communicates with the oil feeding chamber 47 through a second oil feeding passageway 58 which is defined by a groove 57 formed in the valve plate 18, and the gasket 39. The above groove 57 has its one end opening in the secondary oil reservoir chamber 49, and its other end in the oil pumping chamber 47, respectively. The outlet end of the second oil feeding passageway 58 which thus opens in the secondary oil reservoir chamber 49 is provided with an oil discharge valve 59 formed integrally on the gasket 39, to be closed thereby. This oil discharge valve 59 comprises a tab-like reed formed by cutting part of the gasket 39, the reed having its free end disposed for urging contact with a portion of the side surface of the valve plate 18 facing the cylinder block 1 and adjacent the aforementioned one end of the groove 57, to close the passageway 58 when the oil pumping chamber 47 is lower in pressure than the secondary oil reservoir chamber 49, while it is pivotally displaceable away from the above portion of the side surface of the valve plate 18 to open the passageway 58 when the pressure in the oil pumping chamber 47 exceeds that in the secondary oil reservoir chamber 49.

With the above arrangement, when the drive shaft 23 is rotated, the pistons 7 are made to reciprocatingly move within the respective cylinder bores 14, 15, 16 to suck refrigerant gas into the refrigerant pumping chambers 36, 37 and compress and discharge it in cooperation with the suction valves 40, 41, 42 and the discharge valves 43, 44, 45.

Figure 4:
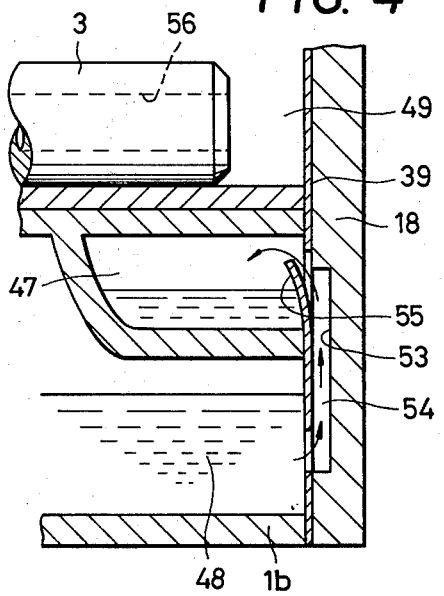
FIG. 4 is a sectional view, on an enlarged scale, of essential part of the compressor of FIG. 1, showing how lubricant oil is sucked into the oil pumping chamber.
Figure 5:
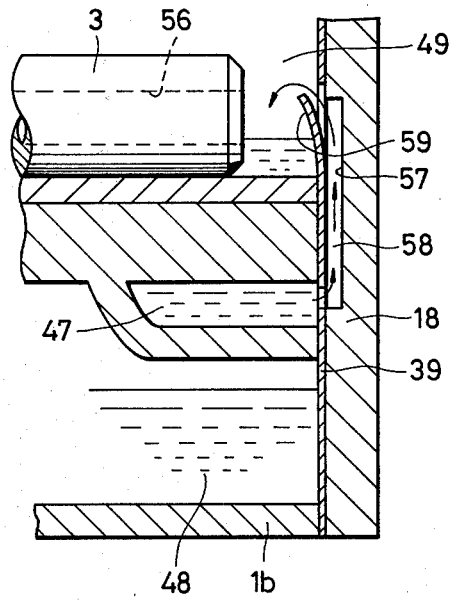
FIG. 5 is a sectional view similar to FIG. 4, showing how lubricant oil is discharged from the oil pumping chamber.

When the refrigerant pumping chamber 37 communicating with the oil pumping chamber 47 comes into the suction stroke, the pressure in the oil pumping chamber 47 drops below that in the primary oil reservoir chamber 48 so that the oil suction valve 55 facing the oil pumping chamber 47 is opened to allow lubricant oil stored in the primary oil reservoir chamber 48 to be sucked into the oil pumping chamber 47 through the first oil feeding passageway 54, as indicated by the arrows in FIG. 4. Whilst, during the discharge stroke of the above refrigerant pumping chamber 37, the pressure in the oil pumping chamber 47 increases above those in the primary and secondary oil reservoir chambers 48, 49 so that the oil suction valve 55 is closed and simultaneously the oil discharge valve 55 facing the secondary oil reservoir chamber 49 is opened to allow lubricant oil in the oil pumping chamber 47 to be pumped into the secondary oil reservoir chamber 27, as indicated by the arrows in FIG. 5.

The lubricant oil thus temporarily stored in the secondary oil reservoir chamber 49 is fed to the radial bearing 8 on the rear side in the through bore 2 to lubricate the same, and also fed through the oil feeding bore 56 in the drive shaft 3 to the thrust bearings 5, 6, the radial bearing 7 on the front side, and the mechanical seal 27, to lubricate these parts.

Figure 6:
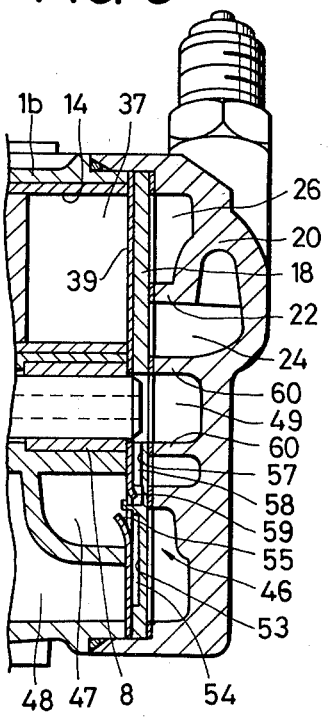
FIG. 6 is a longitudinal sectional fragmentary view illustrating a swash-plate type compressor provided with a lubricant oil feeding system according to a further embodiment of the invention.
Figure 7:
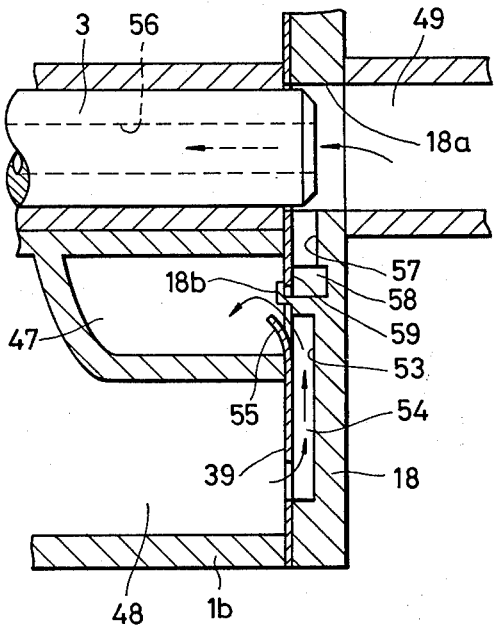
FIG. 7 is a sectional view, on an enlarged scale, of essential part of the compressor of FIG. 6, showing how lubricant oil is sucked into the oil pumping chamber.
Figure 8:
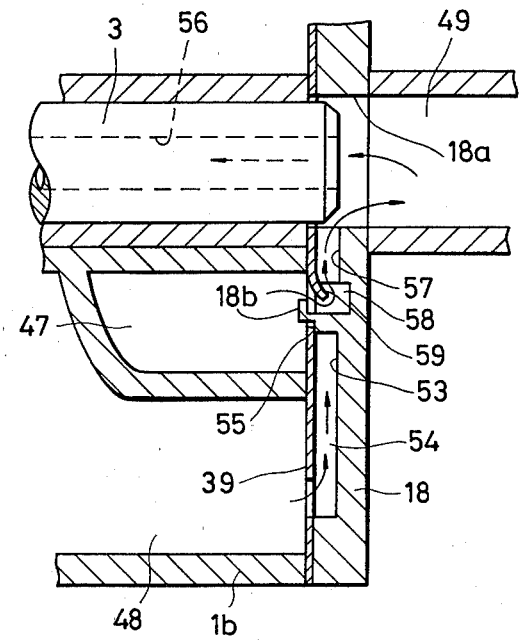
FIG. 8 is a sectional view similar to FIG. 7, showing how lubricant oil is discharged from the oil pumping chamber.

Referring next to FIGS. 6 and 7, there is illustrated another embodiment of the invention. The lubricating oil feeding system according to this embodiment is distinguished from that according to the aforementioned embodiment in the locations of the secondary oil rederevoir chamber 49 and the oil discharge valve 59. More specifically, the secondary oil reservoir chamber 49 is formed in the rear cylinder head 20, that is, it is defined by an annular partition wall 60 formed in the rear cylinder head 20 at a substantially radially central location and axially aligned with the through bore 2 in the cylinder block 1. The partition wall 60 separates this secondary oil reservoir chamber 49 from the low pressure chamber 24 in the cylinder head 20. The secondary oil reservoir chamber 49 communicates with the through bore 2 via a through bore **18*a* formed through the valve plate 18 in axial alignment with the through bore 2. The oil discharge valve 59 is arranged at the inlet end of the second oil feeding passageway 58 in a manner displaceable toward the valve plate 18 to open the passageway 58. To be concrete, a protuberance 18*b* having an L-shaped section is formed on a portion of the valve plate 18 facing the inlet end of the second oil feeding passageway 58 in a manner projecting into the oil pumping chamber 47. The oil discharge valve 59 comprises a reed formed integrally on the gasket 39 as in the previous embodiment, and is disposed for urging contact with the above protuberance 18*b* to close the passageway 58 when the chamber 47 is lower in pressure than the secondary oil reservoir chamber 49, while it is pivotally displaceable away from the protuberance 18*b* and into the passageway 58 to open the same when the chamber 47 is higher in pressure than the chamber 49. Also in this embodiment, when lower pressure prevails in the chamber 47 than in the primary oil reservoir chamber 48, the oil suction valve 55 is opened to allow lubricant oil to be introduced into the oil pumping chamber 47 from the primary oil reservoir chamber 48, as indicated by the arrows in FIG. 7. When the pressure in the chamber 47 is elevated above those in the primary and secondary oil reservoir chambers 48, 49, the oil suction valve 55 is closed and at the same time the oil discharge valve 59 is opened to allow the lubricant oil in the chamber 47 to be forced into the secondary oil reservoir chamber 49, as indicated by the arrows in FIG. 8**.

In this embodiment, the other parts or portions corresponding to those in the previous embodiment are designated by identical numerals, description of which is omitted here.

The present invention is not limited by the abovedescribed two embodiments, and alternatively may be embodied in the following manner, for example:

First, the lubricant oil feeding system 46, which is provided only on the rear side of the compressor according to the aforedescribed embodiments, may be provided on the front side or at both the front side and rear side of the compressor. In this case, the secondary oil reservoir chamber on the front side may be formed in a manner surrounding the drive shaft 3.

Secondly, the first and second oil feeding passageways 54, 58 are formed by the grooves 53, 57 in the valve plate 18 and the gasket 39 in the illustrated embodiments. Considering that these passageways have only to provide communication between the oil pumping chamber 47 and the primary oil reservoir chamber 48 and between the chamber 47 and the secondary oil reservoir chamber 49, respectively, they may be formed in the form of bores formed in the cylinder element **1*b*, or defined by grooves formed in the cylinder element 1*b*, and the gasket 39, or formed through or in the cylinder head 20**, for instance.

Thirdly, the oil suction valve 55 and the oil discharge valve 59 are formed integrally on the gasket 39 in the illustrated embodiments. Since these valves have only to cause opening and closing of the first and second oil feeding passageways 54, 58 in response to pressure change in the oil pumping chamber 47, they may be formed separately from the gasket in suitable manners.

While the invention has been particularly shown and described with reference to preferred embodiments thereof, it will be understood by those skilled in the art that the foregoing and other changes in form and details can be made therein without departing from the spirit and scope of the invention.

What is claimed is:

1. In a swash-plate type compressor, the combination comprising:

a cylinder block having at least one cylinder bore axially extending therethrough, a through bore extending along an axis thereof, and a first oil reservoir chamber formed therein at a bottom portion thereof;

a drive shaft rotatably fitted in said through bore of said cylinder block, said drive shaft having an oil feeding bore extending along an axis thereof;

a swash plate secured on said drive shaft;

at least one piston slidably received within said at least one cylinder bore, said piston defining a fluid pumping chamber in cooperation with said cylinder bore;

an oil pumping chamber permanently communicating via a communication passage with said fluid pumping chamber, said oil pumping chamber being supplied with pressure in said fluid pumping chamber which varies in response to a change in the volume of said fluid pumping chamber;

a second oil reservoir chamber communicating with said oil feeding bore of said drive shaft;

a first oil feeding passageway communicating said oil pumping chamber with said first oil reservoir chamber;

a second oil feeding passageway communicating said oil pumping chamber with said second oil reservoir chamber;

a first valve responsive to a change in the pressure within said oil pumping chamber to open and close said first oil feeding passageway to control supply of lubricant oil solely from said first oil reservoir chamber to said oil pumping chamber; and a second valve responsive to a change in the pressure within said oil pumping chamber to open and close said second oil feeding passageway to control supply of lubricant oil solely from said oil pumping chamber to said second oil reservoir chamber.

2. The swash-plate type compressor as claimed in claim 1, wherein said first valve is arranged in said first oil feeding passageway; and said second valve is arranged in said second oil feeding passageway.

3. The swash-plate type compressor as claimed in claim 1, wherein said communication passage which permanently communicates said oil pumping chamber with said fluid pumping chamber comprises a groove formed in one end face of said cylinder block and extending between said oil pumping chamber and said fluid pumping chamber.

4. The swash-plate type compressor as claimed in claim 3, comprising a gasket generally in the form of a sheet interposed between said cylinder block and said valve plate; said communication passage which permanently communicates said oil pumping chamber with said fluid pumping chamber comprising a groove formed in at least one of the end face of said cylinder block and said gasket.

5. The swash-plate type compressor as claimed in claim 1, including: a valve plate arranged at one end of said cylinder block; and a gasket in the form of a sheet interposed between said cylinder block and said valve plate; said first oil feeding passageway being defined by a first groove formed in one side surface of said valve plate facing said cylinder block and said gasket, said first groove having one end thereof opening in said first oil reservoir chamber and an opposite end thereof in said oil pumping chamber, respectively; said second oil feeding passageway being defined by a second groove formed in said one side surface of said valve plate, and said gasket, said second groove having one end thereof opening in said oil pumping chamber and an opposite end thereof opening in said second oil reservoir chamber, respectively.

6. The swash-plate type compressor as claimed in claim 5, wherein said first valve comprises a reed formed by cutting part of said gasket, said reed being disposed for urging contact with a portion of said one side surface of said valve plate adjacent said opposite end of said first groove to close said first oil feeding passageway when said oil pumping chamber is higher in pressure than said first oil reservoir chamber, said reed being pivotally displaceable away from said portion of said one side surface of said valve plate to open said first oil feeding passageway when said oil pumping chamber is lower in pressure than said first oil reservoir chamber.

7. The swash-plate type compressor as claimed in claim 5, wherein said second valve comprises a reed formed by cutting part of said gasket, said reed being disposed for urging contact with a portion of said one side surface of said valve plate adjacent said opposite end of said second groove to close said second oil feeding passageway when said oil pumping chamber is lower in pressure than said second oil reservoir chamber, said reed being pivotally displaceable away from said portion of said one side surface of said valve plate to open said second oil feeding passageway when said oil pumping chamber is higher in pressure than said second oil reservoir chamber.

8. The swash-plate type compressor as claimed in claim 5, wherein said valve plate includes a protuberance formed thereon and projected into said oil pumping chamber; said second valve comprising a reed formed by cutting part of said gasket, said reed being disposed for urging contact with said protuberance of said valve plate to close said second oil feeding passageway when said oil pumping chamber is lower in pressure than said second oil reservoir chamber, said reed being pivotally displaceable away from said protuberance to open said second oil feeding passageway when said oil pumping chamber is higher in pressure than said second oil reservoir chamber.

9. The swash-plate type compressor as claimed in any one of claims 5, 6, 7 or 8, wherein said oil pumping chamber is defined by a recess formed in said one end of said cylinder block and said gasket, said oil pumping chamber being located between said through bore of said cylinder block and said first oil reservoir chamber.

10. The swash-plate type compressor as claimed in any one of claims 5, 6, 7 or 8, wherein said second oil reservoir chamber is located at one end portion of said through bore of said cylinder block corresponding to said one end of said cylinder block, said second oil reservoir chamber being defined by a peripheral wall of said one end portion of said through bore, one end face of said drive shaft corresponding to said one end portion of said through bore, and said gasket.

11. The swash-plate type compressor as claimed in any one of claims 5, 6, 7 or 8, including a cylinder head secured on said one end of said cylinder block through said valve plate; and wherein said valve plate includes a through bore formed therethrough and axially aligned with said through bore of said cylinder block, said second oil reservoir chamber being formed in said cylinder head at a location axially aligned with said through bore of said cylinder block, said second oil reservoir chamber communicating with said through bore of said cylinder block through said through bore of said valve plate.

* * * * *